US005709631A

United States Patent [19]

Kleinsasser

[11] Patent Number: 5,709,631

[45] Date of Patent: Jan. 20, 1998

[54] STATIONARY EXERCISE SUPPORT FOR A WHEELCHAIR

[75] Inventor: Jonathan Kleinsasser, Ste. Agathe, Canada

[73] Assignee: Crystal Spring Colony Farms Ltd., Ste. Agathe, Canada

[21] Appl. No.: 597,547

[22] Filed: Feb. 2, 1996

[51] Int. Cl.[6] ..... A63B 23/02

[52] U.S. Cl. ..... 482/51; 482/92; 482/904; 280/304.1

[58] Field of Search ..... 482/54, 61, 64, 482/92, 115, 120, 134, 148, 904, 57, 51, 60; 73/117; 280/304.1, 304.2; 434/61

[56] References Cited

U.S. PATENT DOCUMENTS

| | | | |
|---|---|---|---|
| 4,802,666 | 2/1989 | Rodriguez | 482/61 |
| 4,901,560 | 2/1990 | Hirano et al. | 73/117 |
| 4,911,425 | 3/1990 | Kynast et al. | 482/54 |
| 4,912,970 | 4/1990 | Gicewicz | 73/117 |
| 4,966,362 | 10/1990 | Ramaekers . | |
| 5,247,853 | 9/1993 | Dalebout | 482/64 |
| 5,476,429 | 12/1995 | Bigelow et al. | 482/904 |

FOREIGN PATENT DOCUMENTS

| | | | |
|---|---|---|---|
| 2534806 | 4/1984 | France . | |
| 2833354 | 2/1980 | Germany | 482/54 |
| 4215879 | 1/1993 | Germany | 482/92 |
| WO 90 10474 | 9/1990 | WIPO . | |
| WO 91 08024 | 6/1991 | WIPO . | |

OTHER PUBLICATIONS

D & J Development Workshop, Inc., D & J Multiple Training Roller, advertisement in Sports n'Spokes, p. 66, May/Jun. 1994.

FlagHouse Rehab, Wheelchair Treadmill, Spring 1995 catalog, p. 38, 1995.

*Primary Examiner*—Stephen R. Crow
*Assistant Examiner*—Victor K. Hwang
*Attorney, Agent, or Firm*—Adrian D. Battison; Murray E. Thrift

[57] ABSTRACT

A stationary exercise support apparatus for a wheelchair comprises a frame with a pair of horizontal rollers across the frame onto which the wheelchair can be rolled to sit cradled between the rollers. Rotation of the rear wheels of the wheel chair thus drive the rollers while the wheel chair remains stationary on the frame. The wheelchair is held in place by a pair of guide wheels mounted inside the rear wheels of the wheelchair on a support plate behind the rear roller so that the wheelchair is prevented from side to side movement. The wheelchair is held against forward movement off the cradling rollers by a third roller positioned forwardly of the front roller which can be raised and lowered by a handle at one side to a lowered position in a common horizontal plane with the first two rollers in which the wheelchair can roll off the cradled position to a raised position preventing forward movement of the wheelchair.

13 Claims, 2 Drawing Sheets

STATIONARY EXERCISE SUPPORT FOR A WHEELCHAIR

BACKGROUND OF THE INVENTION

This invention relates to a stationary exercise support apparatus for receiving and supporting a wheelchair and occupant for allowing the occupant of the wheelchair to exercise by propelling the wheelchair or remaining in stationary position.

The conventional wheelchair comprises a frame, a seat mounted on the frame, a pair of larger parallel rear wheels rotatable about a horizontal axis and a pair of smaller front castor wheels.

It is known to provide a stationary support onto which the wheelchair can be mounted with a pair of parallel rollers which cradle the wheels to allow the occupant to rotate the wheels while sitting stationary on the support. One example of an arrangement of this type is shown in U.S. Pat. No. 4,966,362 issued Oct. 30, 1990 to RAMAEKERS.

This device does not appear to have been successful since it has not been found commercially available on the market place and since the patent lapsed in 1994 due to non payment of the maintenance fee.

Another device which has been observed in operation but does not appear to have been patented comprises a frame arrangement similar to that of RAMAEKERS with a pair of parallel rollers and a ramp for directing the wheelchair onto the rollers. In this arrangement there is provided a pair of posts behind the rollers and in operation the frame of the wheelchair is clamped to these posts by chains so as to prevent the wheelchair from rolling off the rollers or from moving side to side.

In RAMAEKERS, it is suggested that the wheelchair remains in place on the rollers without the necessity for any additional locating elements. RAMAEKERS provides side wheels at the extreme sides of the frame to prevent the wheels from going beyond the sides of the frame but states that the wheelchair occupant can normally locate the wheelchair at a required position across the width of the frame simply by controlling the rate of rotation of the wheels independently. In addition RAMAEKERS states that the resistance to the rotation of the rollers can be controlled to allow the occupant to provide a high level of force while the chair remains in place on the rollers and yet the resistance can be increased to allow the occupant and the wheelchair to be removed by the occupant from the rollers when the exercise is complete.

In practice it has been found that this location on the chair on the rollers without the addition of locating devices such as the above mentioned posts and chain arrangement is impractical and the wheelchair will both wander side to side and will tend to move forward off the rollers unless properly restrained.

However the post and chain arrangement is a very crude construction requiring intervention by an assistant and giving little confidence to the occupant that the restraint is properly effective. Also, with unequally inflated pneumatic tires, there is a strong tendency of the chair to move to one side and therefore the chains can tend to cause the chair to be dragged off the rollers.

SUMMARY OF THE INVENTION

It is one object of the present invention, therefore, to provide an improved stationary exercise apparatus for a wheelchair in which the wheelchair is more effectively located when in place.

According to one aspect of the invention there is provided a stationary exercise support apparatus for receiving and supporting a wheelchair and occupant for allowing the occupant of the wheelchair to exercise by propelling the wheelchair while remaining in stationary position, the wheelchair comprising a frame, a seat mounted on the frame, a pair of larger parallel rear wheels rotatable about a horizontal axis and a pair of smaller front castor wheels, the apparatus comprising: a first and a second horizontal support roller; a frame mounting the first and second rollers in parallel spaced relations so as to receive the rear wheels of the wheelchair in a cradled position thereon with the axis of rotation of the rear wheel substantially parallel to the rollers rotation of the wheels on the rollers; the first and second rollers each being rotatable about a respective longitudinal axis; a resistance device for resisting rotation of at least one of the rollers so as to provide a resistance to rotation of the wheels against the motive force provided by the occupant; a guide surface on the frame over which the wheels can roll to enter the cradled position; and a third roller parallel to and spaced from each of the first and second rollers and arranged to be movable from a raised position cooperating with the first and second rollers to cradle the wheels to a lowered position allowing the wheels to move from the cradled position on the first and second rollers onto the guide surface.

According to a second aspect of the invention there is provided a stationary exercise support apparatus for receiving and supporting a wheelchair and occupant for allowing the occupant of the wheelchair to exercise by propelling the wheelchair while remaining in stationary position, the wheelchair comprising a frame, a seat mounted on the frame, a pair of larger parallel rear wheels rotatable about a horizontal axis and a pair of smaller front castor wheels, the apparatus comprising: a first and a second horizontal support roller; a frame mounting the first and second rollers in parallel spaced relations so as to receive the rear wheels of the wheelchair in a cradled position thereon with the axis of rotation of the rear wheel substantially parallel to the rollers rotation of the wheels on the rollers; each being rotatable about a respective longitudinal axis; a resistance device for resisting rotation of at least one of the rollers so as to provide a resistance to rotation of the wheels against the motive force provided by the occupant; a guide surface on the frame over which the wheels can roll to enter the cradled position; two guide wheel members each mounted on their frame for engaging and locating the wheels against side to side movement; each of the guide wheel members being arranged for engaging a respective one of the wheels and wherein at least one of the guide wheel members is adjustable so as to vary the spacing between the guide wheel members such that the guide wheel members are located closely adjacent the wheels to prevent the side to side movement.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
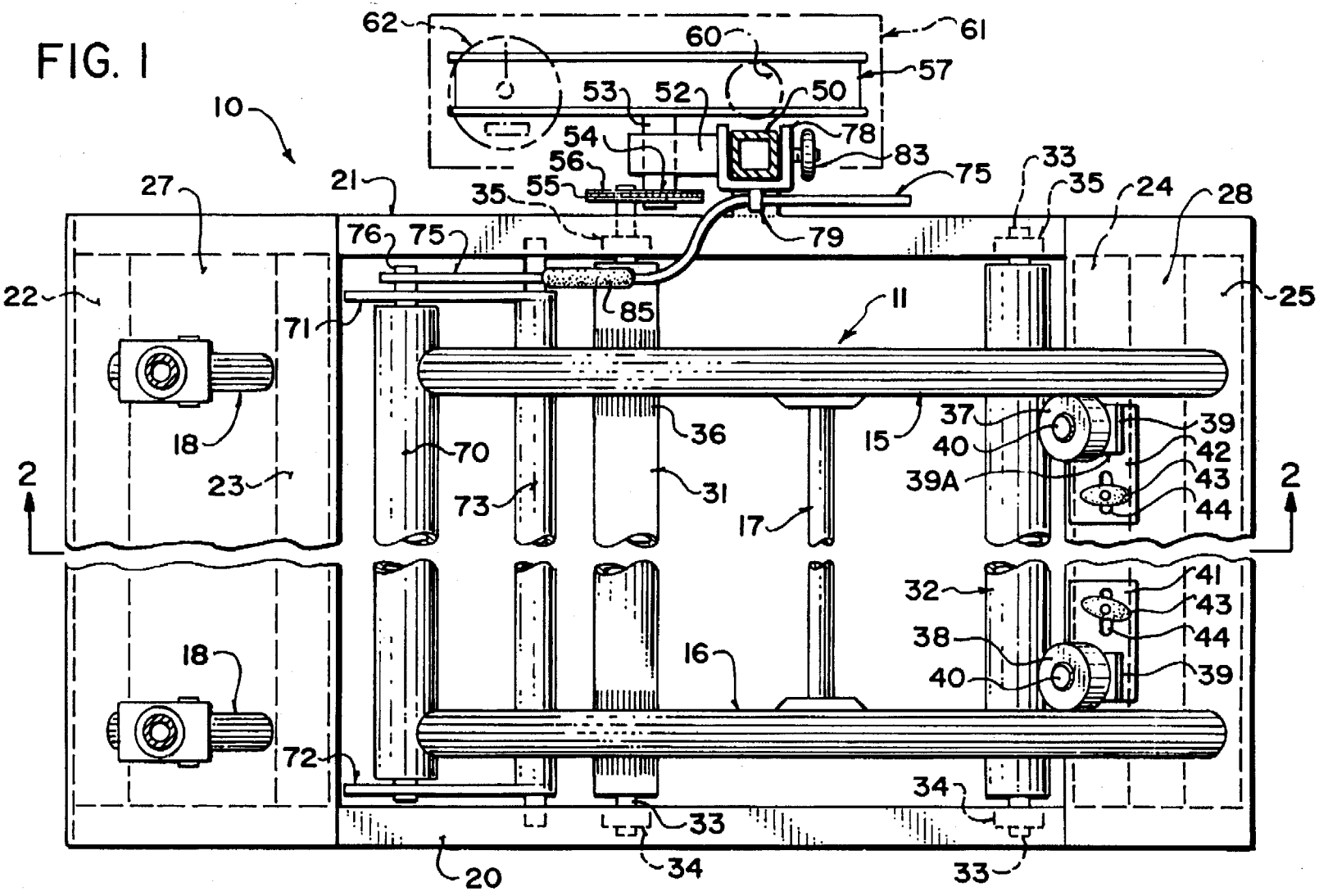
FIG. 1 is a top plan view of an apparatus for receiving a wheelchair for stationary exercise according to the present invention, the wheelchair being shown only in the area of the wheels so as to avoid obscuring vision of the apparatus itself.
Figure 2:
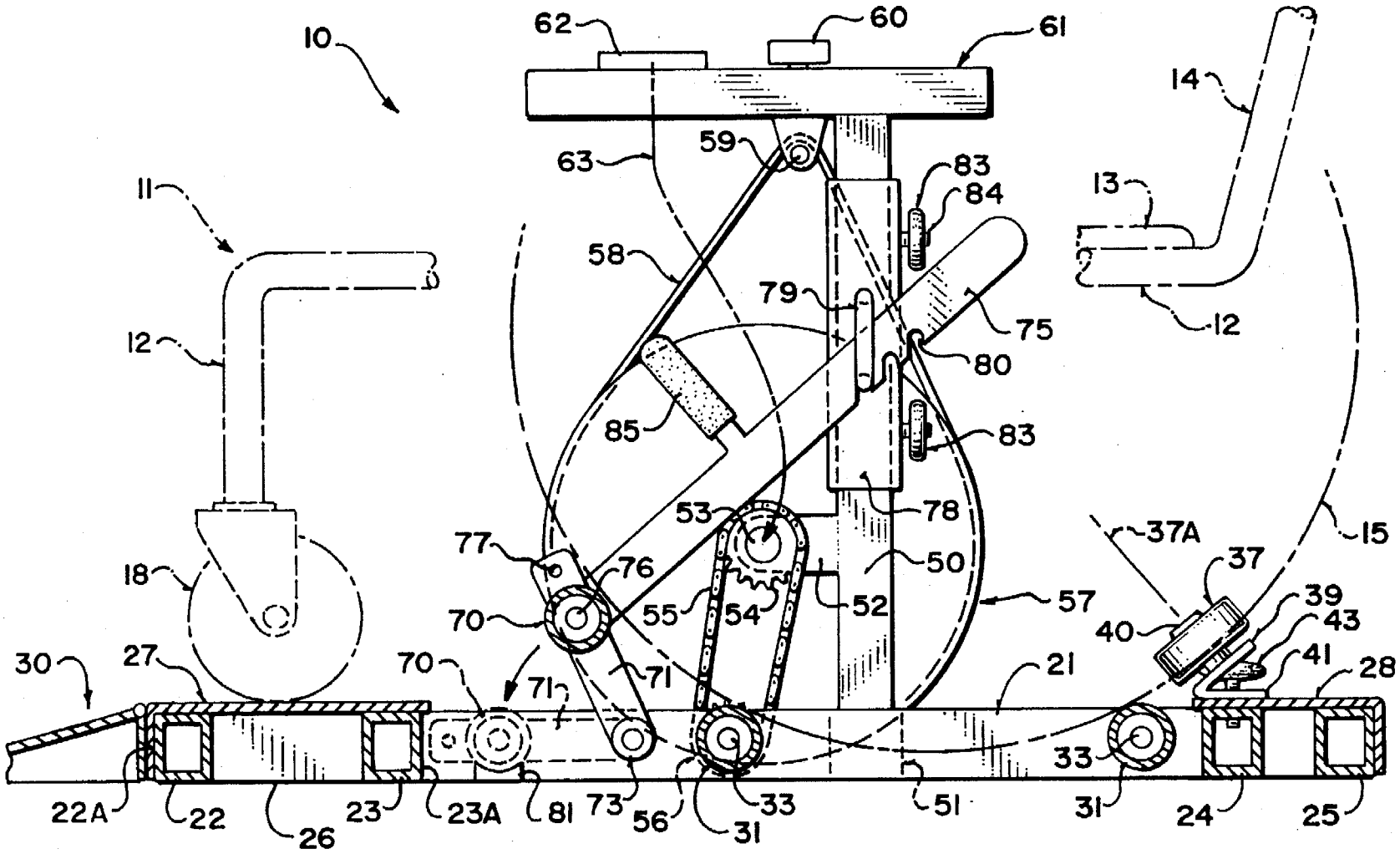
FIG. 2 is a cross sectional view along the lines 2—2 of FIG. 1.

The stationary exercise support apparatus is shown in one embodiment in FIGS. 1 and 2 and is generally indicated at 10 for receiving a wheelchair generally indicated at 11.

The wheelchair is of a conventional nature and therefore will not be described in detail. In addition different types of wheelchair can be used all of which are within the skill of one involved in this art. In general the wheelchair includes a frame 12 carrying a seat 13 with a back rest 14. The frame is attached to a pair of rear wheels 15 and 16 which are mounted on an axle 17 for independent rotation, the axle supporting the frame, the seat and the occupant carried within the seat. The frame is supported forwardly of the main rear wheels 15 and 16 by a pair of front wheels which are generally castor wheels so as to follow direction of movement as controlled by the occupant by pushing the main rear wheels 15 and 16. Thus the occupant while seated in the wheelchair grasps the wheel rims at the upper part thereof so as to push the wheels forwardly or rearwardly to provide forward and rearward movement and in addition the occupant can steer the wheelchair by independent rotation of the wheels 15 and 16. In some cases the wheels 15 and 16 includes hand rails but these are not illustrated in the Figures for convenience of illustration.

The apparatus 10 for supporting the wheelchair comprises a base frame defined by a pair of side rails 20 and 21 which are interconnected by a plurality of cross rails. In the embodiment shown there are four such cross rails indicated at 22, 23, 24 and 25 although this number may vary in accordance with design and strength requirements. Each of the rails is formed from a square tube so as to form a rectangular structure with an underside 26 for resting on a support surface generally the floor. A forward part of the frame is covered by a sheet 27 of metal to define a guide surface over which the wheels of the wheelchair can roll and upon which the front wheels of the wheelchair sit when the wheelchair is received in the operating position. The sheet 27 extends from a rear face 23A of the cross rail 23 across the space between the rails 22 and 23 and down the front face 22A of the cross rail 22. The sheet further extends across the full width of the frame so as to sit on top of the side rails 20 and 21.

A rear part of a frame is similarly covered by a sheet 28 which extends from a front face of the rail 24 and covers the area between the rails 20, 21, 24 and 25 and extends to a rear portion turned downwardly over the rear face of the rail 25.

In the area defined rearwardly of the rail 23, forwardly of the rail 24 and between the side rails 20 and 21 there is an open area within which the rear wheels 15 and 16 of the wheelchair sit in the operating position.

A separate ramp 30 can be provided forwardly of the rail 22 so as to allow the wheelchair to move upwardly from the floor surface smoothly onto the sheet 27 during mounting of the wheelchair onto the apparatus.

The apparatus further comprises a first roller 31 and a second roller 32 which extend across the full width of the frame and are mounted each on a respective shaft 33 carried in a pair of bearings 34 and 35 in the rails 20 and 21 respectively. Each roller thus forms a cylindrical surface onto which the rear wheels 15 and 16 can sit so that the wheels are cradled between the rollers 31 and 32. The rollers have a diameter substantially equal to the height of the rails of the frame so that the rollers just clear the floor surface allowing them to rotate without interference with the floor surface and yet the rollers do not project significantly above the top surface of the frame. The spacing between the rollers is of the order of eight to ten inches which allows the wheels 15 and 16 to be cradled without the wheels extending downwardly at their lowermost position to a position into contact with the floor surface. This spacing allows also the chair to be rolled off the rollers from the cradled position without the necessity for high forward force to raise the chair upward from the cradled position over the top of the first roller.

The first roller 31 is knurled as indicated at 36 so as to provide frictional engagement with the tires of the wheels 15 and 16. Both rollers are preferably formed from aluminum which provides sufficient strength to support the wheelchair and occupant, relatively light weight and a smooth running effect.

The wheels 15 and 16 are prevented from movement side to side along the length of the rollers by a pair of guide wheels 37 and 38 which are mounted on the frame at the rail 24. As shown, the guide wheels are mounted between the wheels 15 and 16 facing outwardly; but it is also possible that the guide wheels can be mounted outside the wheels and facing inwardly. Thus each guide wheel 37, 38 is mounted upon a plate 39 on an upper face of which is mounted a shaft 40 carrying bearings for the wheel 37, 38. The plate 39 forms part of a mounting bracket including a second angle plate 41 which is arranged at an angle relative to the plate 39 so as to present the wheel 37, 38 at the required position such that the axis 37A of the wheels 37 and 38 are directed toward the axle 17. The base plate 41 of the bracket extends inwardly beyond an inner edge 39A of the plate 39 to form a mounting plate portion 42 which is clamped to the rail 24 through the sheet 28 by a hand wheel 43. The plate 41 includes a slot 44 by which its position can be adjusted in a direction longitudinal of the rail 24 to adjust the spacing between the wheels 37 and 38.

The wheels 37 and 38 are thus positioned inwardly of the wheelchair wheels 15 and 16 and are mounted behind the wheelchair rather than at the ends of the roller 31 and 32. This allows the spacing to be adjusted so that the wheels are immediately adjacent or closely adjacent to the inside surface of the wheels so as to prevent side to side wandering of the wheelchair when it is in position on the rollers.

It has been found that the wheelchairs, particularly with pneumatic tires, will wander side to side unless suitably constrained against side to side movement and this movement or wandering cannot be controlled by the occupant simply by rotation of the wheels 15 and 16. The guide wheels thus hold the wheelchair centered and prevent the side to side movement which could be disconcerting to the occupant.

On one side of the frame is mounted a support post 50 which is attached to the rail 21 by a mounting block 51. The post 50 comprises a square tube which is thus rigid and vertical and positioned outwardly to one side of the frame. The post 50 carries a bearing block 52 which extends from the post 50 horizontally to one side of the post that is in a plane parallel to the rail 21, the bearing block 52 carrying a shaft 53 which has an axis at right angles to the side of the frame. The shaft 53 carries a sprocket 54 which is driven by a chain 55 from a second sprocket 56 on an end of the shaft 33 of the roller 31. The shaft 33 of the roller 31 thus projects through the rail 21 with a sprocket 56 mounted on the outer end of the shaft so as to be aligned with the sprocket 54 on the shaft 53. Rotation of the roller 31 is thus communicated through the sprockets and chain to the shaft 53. The shaft 53 carries a flywheel 57 which is relatively large in diameter in comparison with the shaft 53 and has sufficient mass to maintain momentum of the system between pushing strokes from the occupant. The flywheel 57 also acts as a frictional resistance and has a belt 58 wrapped around the wheel with that belt passing over a shaft 59 spaced away from the periphery of the wheel 57. The shaft 59 attached to the belt and therefore holds the belt stationary so that the wheel 57 when rotated by the shaft 53 is rotated against the friction provided between the belt and the periphery of the wheel. The height of the shaft 59 can be adjusted by a hand wheel 60 attached to a control table 61 carried on the post 50. For convenience of illustration, the table 61 and the handle 60 are shown in dotted line in FIG. 1.

The table 61 also carries a tachometer 62 which will display to the occupant a rate of rotation of the shaft 53 and also a summation of the number of rotations of the shaft 53 so as to indicate a distance traveled by the rotation of the wheels 15 and 16. A cable responsive to the rotation of the shaft 53 is schematically indicated at 63.

A third roller 70 is provided also on the frame and lies parallel to the first roller 31 and the second roller 32. Instead of being mounted directly on the rails 20 and 21, the third roller 70 is mounted on a pair of side arms 71 and 72 which are carried on a pivot shaft 73 which is in turn mounted on the side rails 20 and 21. The pivot shaft 73 extends across the full width of the frame and is mounted at each ends on the rails 20 and 21 for pivotal movement about a horizontal axis longitudinal of the shaft 73. The shaft 73 is located between the first roller 31 and the third roller 70.

The pivotal mounting of the pivot shaft 73 thus allows the third roller 70 to move from a lowered position shown in dotted line in FIG. 2 and also shown in FIG. 1 to a raised position shown in full line in FIG. 2.

In the lowered position shown in FIGS. 1 and 2, the roller 70 lies in a common horizontal plane with the first and second rollers that is within the frame. In this position the wheels 15 and 16 of the wheelchair can roll over the rollers from the guide surface 27 to take up the position cradled between the rollers 31 and 32.

Thus a tangent to the top surface of the roller 70 lies substantially in the same horizontal plane as a tangent to the top of the rollers 31 and 32 and containing also the sheet 27. The wheels of the wheelchair can therefore roll directly from the guide surface or sheet 27 over the roller 70, over the pivot shaft 73, over the roller 31 and into the cradled position between the rollers 31 and 32.

When the wheelchair is thus in the cradled position shown in FIGS. 1 and 2, the roller 70 can be moved to the raised position by pivoting the arms 71 and 72 about the axis of the shaft 73 so that the roller 70 takes up a position in which it acts also to cradle the wheels 15 and 16 that is its spacing from the centre of the wheels 15 and 16 substantially equal to that of the rollers 31 and 32. This movement of the third roller 70 is effected by an actuating arm 75 which has a lower end pivotally connected to the arm 71.

In the embodiment shown, a shaft 76 of the roller 70 projects through holes 77 in the arms 71 and 72 and the lower end of the actuating arm 75 is attached to the end of the shaft 76. The arms 71 and 72 include a series of the holes 77 through which the shaft can pass so that one of the holes 77 can be selected to provide a course adjustment of the position of the roller relative to the arms 71 and 72. The actuating arm 75 extends upwardly from the end of the roller 70 and longitudinally of the frame to a position engaging a slide member 78 on the post 50. The slide member 78 comprises a channel of rectangular cross-section so as to closely surround the square post with a rear face of the slide member being open to fit onto the post in assembly. On one side wall of the channel forming the slide member is provided a guide plate 79 along one side of the slide member so as to define a slot between the adjacent surface of the slide member and the inside of the plate through which the actuating arm extends. The actuating arm includes a series of notches 80 on its underside for engagement with the plate 79 in the raised position with the operator or occupant being free to select one of the notches for adjusting the height to which the roller is raised.

The slide member 78 is mounted on the outside of the post 50 and is movable vertically relative thereto to selected positions. The slide member is clamped to the post by a pair of hand wheels 83 which operate on pins 84 projecting from the post. The slide member 78 has slots along which the pins can slide so that the height of the slide member can be raised and lowered relative to the post and clamped in a selected position by actuating the hand wheels 83. This adjustment varies the position of the notch 80 relative to the axis of the pivot shaft 73 so that the movement of the slide member provides a fine adjustment of the position of the roller 70 about the axis of the shaft 73.

A handle 85 is mounted on the actuating arm 75 and projects at right angles thereto so as to extend upwardly and outwardly away from the occupant of the chair. The occupant of the chair can therefore reach down to the handle 85 and can move the actuating arm 75 either upwardly or downwardly as required to raise and lower the roller 70.

In the raised position of the roller 70, therefore, the roller cooperates with the first and second rollers in a cradling action and increases the length of the periphery of the wheels 15 and 16 which is cradled. In order for the wheelchair therefor to be lifted from its cradled position with the roller 70 raised, it is necessary for the wheelchair to pivot over the roller 70 thus requiring a significant lifting action of the centre of gravity of the chair. The chair is therefore maintained against such movement even in the event of significant application of propulsion force by the applicant to the chair.

In the lowered position of the roller, the roller 70 rests upon a stop 81 mounted on the frame underneath the roller to prevent movement of the roller downwardly beyond the lowered position and to prevent rotation of the roller in the lowered position. In this position, with the roller held against rotation, the wheelchair can be moved forwardly from its cradled position simply by pivoting the wheels over the roller 31 so that the centre of gravity needs to be raised only by relatively small amount. The occupant can therefore alone move the wheelchair from the ramp 30 into the cradled position, raise the roller 70 and thus commence exercising activity by propelling the wheelchair forward while it is held in stationary position on the frame. When the exercise is complete, the occupant can lower the actuating arm 75 to lower the roller 70 to the lowered position and then simply roll forwardly by providing sufficient propulsion force to move over the rollers in a generally horizontal plane across the top of the frame to the guide surface 27 and the ramp 30.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A stationary exercise support apparatus for receiving and supporting a wheelchair and occupant for allowing the occupant of the wheelchair to exercise by propelling the wheelchair while remaining in stationary position, the wheelchair comprising a wheelchair frame, a seat mounted on the wheelchair frame, a pair of larger parallel rear wheels rotatable about a horizontal axis and a pair of smaller front castor wheels, the apparatus comprising:

a first and a second roller, the first and second rollers each being rotatable about a respective longitudinal, horizontal axis;

a main frame mounting the first and second rollers with the respective axes thereof in parallel spaced relation so as to receive and support the rear wheels of the wheelchair in a cradled position on the first and second rollers with the horizontal axis of rotation of the rear wheels substantially parallel to the axes of the first and second rollers for rotation of the rear wheels on the first and second rollers;

a guide surface on the main frame over which the rear wheels can roll to enter the cradled position;

a third roller parallel to and spaced from each of the first and second rollers and arranged to be movable relative to the first and second rollers and relative to the main frame, in a direction transverse to the axes of the first and second rollers and transverse to the horizontal axis of the rear wheels so as to change a distance of the third roller from the horizontal axis of the rear wheels, from a raised position in which the third roller cooperates with the first and second rollers to cradle the rear wheels to a lowered position in which the third roller is spaced from the rear wheels while the rear wheels are cradled by the first and second rollers allowing the rear wheels to move from the cradled position on the first and second rollers onto the guide surface;

and a resistance device for resisting rotation of at least one of the rollers so as to provide a resistance to rotation of the rear wheels against a motive force provided by the occupant.

2. The apparatus according to claim 1 wherein the third roller includes a lift bar at one end of the third roller with a manually graspable handle for pulling the lift bar and the third roller upwardly from the lowered position to the raised position.

3. The apparatus according to claim 2 wherein the lift bar engages a post member standing upwardly from the main frame and the lift bar includes means thereon for cooperating with the post member to hold the lift bar in the raised position.

4. The apparatus according to claim 3 including means on the post member for adjusting the height of the third roller in the raised position of the third roller.

5. The apparatus according to claim 1 including means for providing fine adjustment of the third roller in the raised position so as to adjust the height thereof relative to the first and second rollers to accommodate different diameters of rear wheel of different wheelchairs.

6. The apparatus according to claim 1 wherein one of the rollers is knurled for engagement with the rear wheels such that rotation of the rear wheels provides drive of said one roller against said resistance device.

7. A stationary exercise support apparatus for receiving and supporting a wheelchair and occupant for allowing the occupant of the wheelchair to exercise by propelling the wheelchair while remaining in stationary position, the wheelchair comprising a wheelchair frame, a seat mounted on the wheelchair frame, a pair of larger parallel rear wheels rotatable about a horizontal axis and a pair of smaller front castor wheels, the apparatus comprising:

a first and a second roller, the first and second rollers each being rotatable about a respective longitudinal, horizontal axis;

a main frame mounting the first and second rollers with the respective axes thereof in parallel spaced relation so as to receive and support the rear wheels of the wheelchair in a cradled position on the first and second rollers with the horizontal axis of rotation of the rear wheels substantially parallel to the axes of the first and second rollers for rotation of the rear wheels on the first and second rollers;

a guide surface on the main frame over which the rear wheels can roll to enter the cradled position;

a third roller rotatable about an axis of the third roller parallel to and spaced from the axes of each of the first and second rollers and arranged to be movable from a raised position in which the third roller cooperates with the first and second rollers to cradle the rear wheels to a lowered position in which the third roller is spaced from the rear wheels allowing the rear wheels to move from the cradled position on the first and second rollers onto the guide surface;

and a resistance device for resisting rotation of at least one of the rollers so as to provide a resistance to rotation of the rear wheels against a motive force provided by the occupant;

wherein the main frame includes a pair of side rails with each of the first and second rollers having a first end mounted on a first of the side rails and a second end mounted on a second of the side rails;

and wherein the third roller is mounted on a pair of arms each arranged adjacent a respective one of the side rails with each arm being pivotal relative to the respective one of the side rails about an axis parallel to and spaced from the axis of the third roller such that pivotal movement of the arms relative to the respective side rails causes a lifting movement of the third roller relative to the main frame and relative to the first and second rollers carried on the main frame.

8. The apparatus according to claim 7 wherein the third roller includes a lift bar at one end of the third roller with a manually graspable handle for pulling the lift bar and the third roller upwardly from the lowered position to the raised position.

9. The apparatus according to claim 8 wherein the lift bar engages a post member standing upwardly from the main frame and the lift bar includes means thereon for cooperating with the post member to hold the lift bar in the raised position.

10. The apparatus according to claim 9 including means on the post member for adjusting the height of the third roller in the raised position of the third roller.

11. The apparatus according to claim 7 including means for providing fine adjustment of the third roller in the raised position so as to adjust the height thereof relative to the first and second rollers to accommodate different diameters of rear wheel of different wheelchairs.

12. The apparatus according to claim 7 wherein one of the rollers is knurled for engagement with the rear wheels such that rotation of the rear wheels provides drive of said one roller against said resistance device.

13. A stationary exercise support apparatus for receiving and supporting a wheelchair and occupant for allowing the occupant of the wheelchair to exercise by propelling the wheelchair while remaining in stationary position, the wheelchair comprising a wheelchair frame, a seat mounted on the wheelchair frame, a pair of larger parallel rear wheels rotatable about a horizontal axis and a pair of smaller front castor wheels, the apparatus comprising:

a first and a second roller, the first and second rollers each being rotatable about a respective longitudinal, horizontal axis;

a main frame including two parallel side rails and a rear cross rail connecting the side rails, the side rails mounting the first and second rollers with the respective axes thereof in parallel spaced relation so as to receive and support the rear wheels of the wheelchair in a cradled position on the first and second rollers with the horizontal axis of rotation of the rear wheels substantially parallel to the axes of the first and second rollers for rotation of the rear wheels on the first and second rollers;

a resistance device for resisting rotation of at least one of the rollers so as to provide a resistance to rotation of the wheels against the motive force provided by the occupant;

a guide surface on the main frame in front of the first and second rollers over which guide surface the rear wheels can roll to enter the cradled position;

guide means mounted on the main frame for engaging and locating the rear wheels against side to side movement;

the guide means consisting only of a first and a second guide wheel member, each of the guide wheel members being arranged for engaging a respective one of the rear wheels;

each guide wheel member comprising a guide wheel and a mounting bracket for the guide wheel clamped to the rear cross rail at a position thereon to locate the guide wheel inwardly of a respective one of the rear wheels with each of the brackets being adjustable independently in a direction longitudinally of the rear cross rail so as to vary a spacing between the guide wheels such that the guide wheels are located closely adjacent inside surfaces of the rear wheels to prevent the side to side movement of the rear wheels and such that outside surfaces of the rear wheels are free from engagement with guide wheels.

* * * * *